US005653584A

United States Patent [19]

Mazzucato et al.

[11] Patent Number: 5,653,584

[45] Date of Patent: Aug. 5, 1997

[54] MOTOR/PUMP MOUNTING ARRANGEMENT FOR A VERTICALLY MOUNTING HIGH PRESSURE WATER PUMP

[75] Inventors: Roberto Mazzucato, Milan; Carlo A. Cuneo, Crema, both of Italy; Gus Alexander, Hoffman Estates, Ill.

[73] Assignee: Officine Meccaniche FAIP S.r.l., Cremasco, Italy

[21] Appl. No.: 516,496

[22] Filed: Aug. 17, 1995

[51] Int. Cl.[6] ..... F04B 53/22

[52] U.S. Cl. ..... 417/360; 417/364

[58] Field of Search ..... 417/360, 364, 417/271, 234; 403/23, 164

[56] References Cited

U.S. PATENT DOCUMENTS

| | | | |
|---|---|---|---|
| 1,846,360 | 2/1932 | Rudolph | 417/271 |
| 1,901,501 | 3/1933 | Ferris | 417/271 |
| 1,996,789 | 4/1935 | Baker | 417/271 |
| 3,106,057 | 10/1963 | Manning et al. | 417/364 |
| 4,557,669 | 12/1985 | Vanderjagt | 417/271 |
| 4,567,456 | 1/1986 | Legatti . | |
| 4,792,096 | 12/1988 | Gregory . | |
| 4,851,724 | 7/1989 | Polk et al. . | |
| 5,201,638 | 4/1993 | Bieri | 417/234 |
| 5,314,096 | 5/1994 | Fesl et al. . | |
| 5,395,053 | 3/1995 | Frech . | |
| 5,494,414 | 2/1996 | Steinhart et al. | 417/360 |

FOREIGN PATENT DOCUMENTS

| | | | |
|---|---|---|---|
| 2480865 | 10/1981 | France | 417/271 |

*Primary Examiner*—Timothy Thorpe
*Assistant Examiner*—Roland G. McAndrews, Jr.
*Attorney, Agent, or Firm*—McDonnell Boehnen Hulbert & Berghoff, Ltd.

[57] ABSTRACT

A vertically oriented high pressure water pump system including a vertically oriented motor, an intermediate flange and an axial drive water pump wherein the intermediate flange verticaly unites the motor and the high pressure water pump and further includes an axial thrust bearing and a thrust bearing sleeve for coupling the motor drive shaft in the axial drive pump.

8 Claims, 5 Drawing Sheets

Fig. 1B
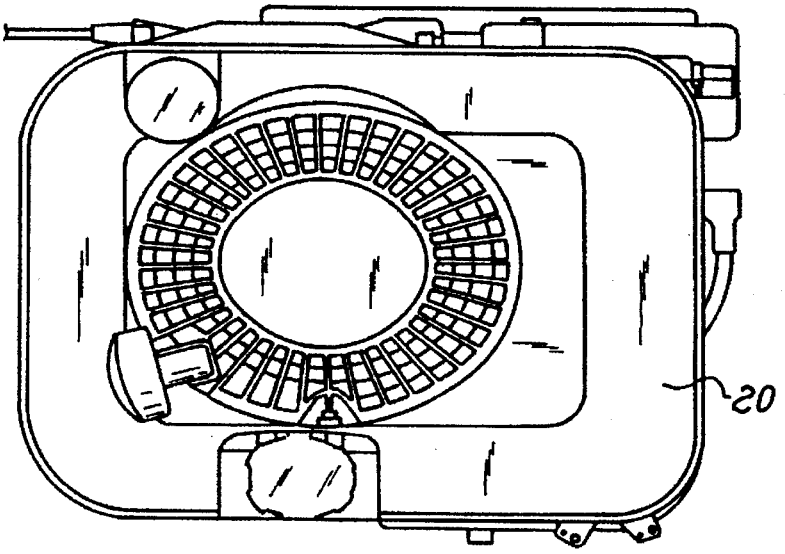
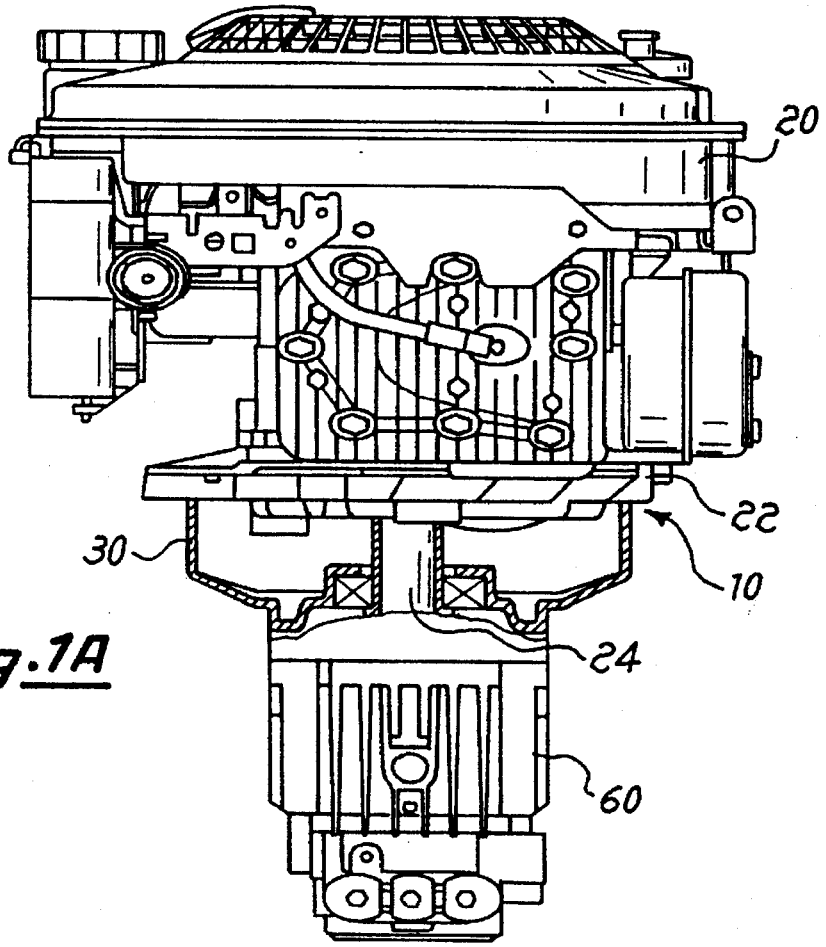
Fig. 1A

MOTOR/PUMP MOUNTING ARRANGEMENT FOR A VERTICALLY MOUNTING HIGH PRESSURE WATER PUMP

BACKGROUND OF THE INVENTION (1) Field of the Invention

This invention concerns a high pressure water pump system that is designed to be driven with a standard vertically mounted motor like those used to power consumer lawn mowers. The high pressure water pump system uses an intermediate flange, including an axial thrust bearing, to unite the vertically mounted motor to an axial driven pump. The high pressure water pump system may optionally include vibration dampeners located between the intermediate flange and a horizontal platform to reduce motor noise and vibrations.

(2) Description of the Art

Small high pressure water pumps driven by motors are well known in the art. For example, U.S. Pat. No. 5,395,053 describes a high pressure cleaning device where the motor, including the motor drive shaft, is horizonatally oriented.

Other commercially available high pressure water pump systems include horizontally mounted motors, or include vertically mounted motors that include a shaft sleeve that is eliminated by the intermediate flange used in the pump system of this invention.

SUMMARY OF THE INVENTION

Small, reliable high pressure water pump systems are gaining popularity among consumers. Presently available high pressure water pump systems are inexpensive, reliable, compact, and easy to use. They are also useful for a variety of purposes, some of which include washing automobiles and home sidings. The majority of high pressure water pump systems purchased by consumers are horizontally oriented because conventional motors used in high pressure water pump systems must typically be associated with gear reducers or shaft sleeves in order to efficiently operate the pump using a rotating motor drive shaft. This makes the pump system quite long and, therefore, awkward for vertical mounting.

It is an object of this invention, therefore, to provide a vertically oriented high pressure water pump system that is shorter in length than conventional high pressure water pump systems.

It is another object of this invention to provide a vertically oriented high pressure water pump system that is compatible with standard consumer motors such as internal combustion or electric motors used in consumer lawn mowers.

It is yet another object of this invention to provide a vertically oriented high pressure water pump system that includes an axial thrust bearing associated with an intermediate flange that allows the drive shaft of a vertically oriented motor to be directly connected to an axially driven pump.

In one embodiment, this invention is a vertically oriented high pressure water pump system. The vertically oriented high pressure water pump system includes a motor having a motor housing and a downwardly oriented vertical drive shaft. The pump system also includes an axial drive pump that is driven by the motor drive shaft. An intermediate flange is positioned between the motor and the pump. The intermediate flange includes an aperture and a first recess. A means for uniting the pump and motor compressively fixes the intermediate flange between the motor and the axial drive pump. An axial thrust bearing is located in the first recess of the intermediate flange. A drive shaft sleeve is attached to the drive shaft and the drive shaft sleeve is at least partially surrounded by the axial thrust bearing so that rotation of the drive shaft causes the thrust bearing and the drive shaft sleeve to rotate in unison thereby driving the pump.

In another embodiment, this invention is a vertically oriented high pressure water pump system including an internal combustion engine, an axial drive piston pump and an intermediate flange where the pump system is associated with a horizontal platform. The pump system engine includes a motor housing and a downwardly oriented vertical drive shaft. An intermediate flange having an aperture, a first recess, a second recess, and a plurality of first bolt apertures spaced at 120° intervals around the circumference of the intermediate flange is positioned between the motor and the axial drive piston pump. An axial thrust bearing is fixedly located in the first recess of the intermediate flange and the drive shaft sleeve is attached to the drive shaft and at least partially surrounded by the axial thrust bearing so that rotation of the drive shaft causes the thrust bearing and the drive shaft sleeve to rotate in unison. The axial drive piston pump includes a plurality of second bolt apertures complementary to the first bolt apertures. A bolt is passed through each first and second bolt aperture and tightened to compressively secure the intermediate flange between the engine and the axial drive piston pump. A wobble disc assembly is located in the second recess of the intermediate flange and it is attached to the end of the drive shaft. Drive shaft rotation causes the wobble disc to rotate which, in turn, drives the axial drive piston pump. The assembled pump system is attached to horizontal platform associated with a cart by way of a plurality of vibration dampeners. Each vibration dampener includes a first threaded end for attaching the vibration dampener to the horizontal platform and a second threaded end for attaching the vibration dampener to the intermediate flange.

DESCRIPTION OF THE DRAWINGS

There is shown in the drawings a presently preferred embodiment of the vertically oriented high pressure water pump system of the present invention wherein like numerals in the various figures pertain to like elements and wherein:

FIG. 1A and 1B are front and top schematic views, respectively, of an embodiment of a vertically oriented high pressure water pump system of this invention;

Figure 2:
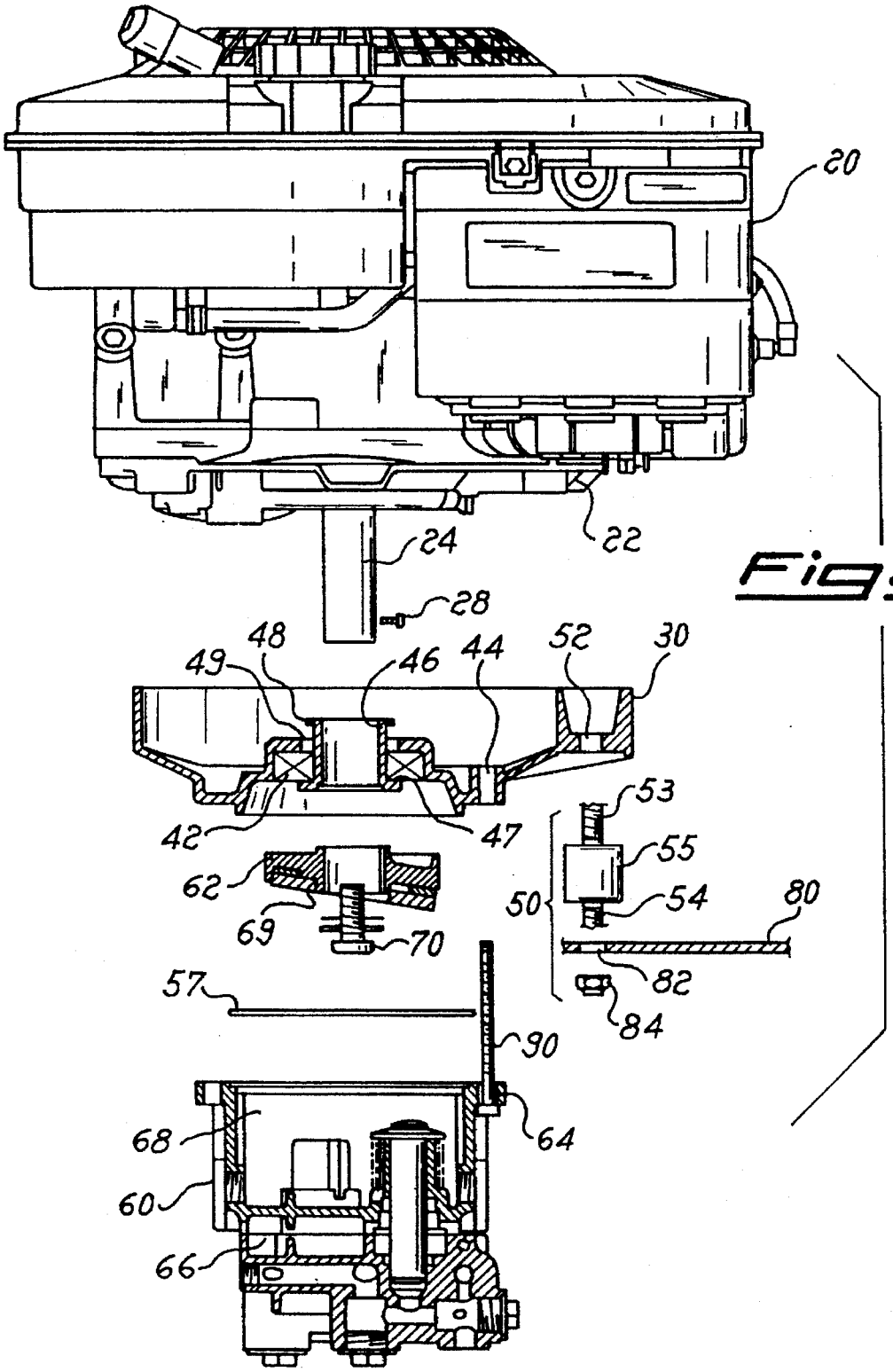
FIG. 2 is an assembly view of an embodiment of a high pressure water pump system of this invention including cut-away views of the intermediate flange and of an axial drive piston pump.

It should be understood that terms used herein as "top", "bottom", "end", "first", "second", and "associated with" have reference only to the structures shown on the drawings as they would appear to a person viewing the drawings and are used merely to simplify the description of this invention. The figures are drawn to show the basic teachings of the present invention including the positional relationships of the parts that perform various functions of the invention. Unless explained in detail, the dimensional proportions, materials of construction and so forth are well within the understanding of those of skill in the art.

DESCRIPTION OF THE CURRENT EMBODIMENT

The present invention relates to a high pressure water pump system that is driven by a motor that is vertically mounted. By "vertically mounted" it is meant that the motor drive shaft must be oriented vertically and downwardly. A vertically oriented motor associated with an intermediate flange and an axial drive pump defines a pump system of this invention that is short and compact.

The vertically oriented high pressure water pump system of this invention is designated by the numeral 10 in the various figures. Pump system 10 includes a motor 20, an axial drive pump 60, and an intermediate flange 30 for uniting motor 20 with axial drive pump 60. High pressure water pump system 10, when assembled, is associated with a horizontal platform 80 so that the vertically oriented high pressure pump remains in a vertical position.

Referring now to FIGS. 1A and 1B, pump system 10 of this invention includes a motor 20 having a housing 22 and a vertically and downwardly oriented drive shaft 24. Motor 20 may be any type of motor that is able to provide sufficient torque to operate axial drive pump 60. It is preferred that motor 20 is an electric motor or internal combustion engine of the type used for consumer upright lawn mowers. Such motors are capable of generating between 3 horsepower and 10 horsepower allowing pump system 10 of this invention to generate from 1,500 to 4,000 psi of water pressure.

It is preferred that motor 20 is an internal combustion engine. It is important that the preferred internal combustion engine 20 remain vertically oriented. If the motor is tipped, then gasoline can leak from the motor causing safety problems. Thus, the preferred vertically oriented high pressure water pump 10 of this invention will be secured, vertically, in horizontal platform 80.

Motor 20 is associated with drive shaft 24 and causes it to rotate axially. Intermediate flange 30 unites motor 20 and drive shaft 24 with pump 60 and allows drive shaft 24 to rotate while preventing non axial rotation or movement of drive shaft 24. Intermediate flange 30 also aids in efficiently transferring the rotational power of drive shaft 24 to axial drive pump 60.

Figure 3C:
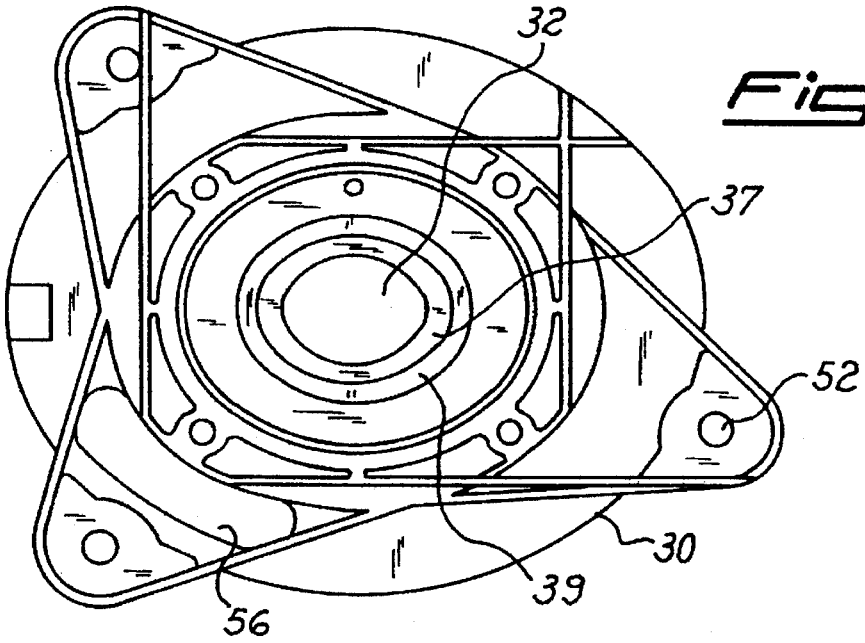
FIGS. 3A, 3B, and 3C are side cutaway, top, and bottom views, respectively, of an intermediate flange useful in a vertically oriented high presssure water pump system of this invention.
Figure 3B:
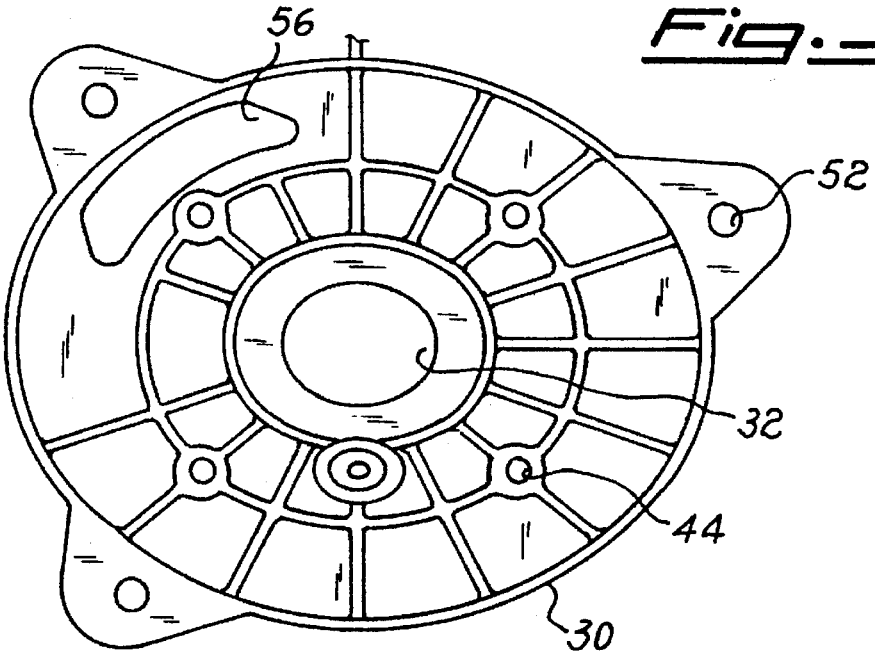
Figure 3A:
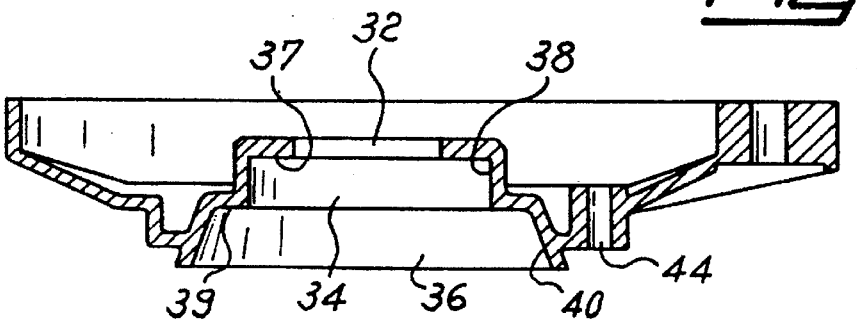

An embodiment of intermediate flange 30 is shown in FIGS. 3A, 3B, and 3C. Intermediate flange 30 includes an aperture 32 located approximately in the center of intermediate flange 30. Intermediate flange 30 includes a first recess 34 and a second recess 36 which both include aperture 32. First recess 34 and second recess 36 are coaxial to aperture 32. First recess 34 is defined by first circumferential face 37 and first cylindrical wall 38 while second recess 36 is defined by second circumferential face 39 and second cylindrical wall 40. First recess 34 is sized to accept axial thrust bearing 42, while second recess 36 is sized to accept wobble disc assembly 62.

Intermediate flange 30 is associated with motor 20 by any means known in the art for uniting a flange with a motor. It is preferred that intermediate flange 30 is removably and compressibly associated with motor 20 with bolts that pass from axial drive pump 60 into motor 20 via intermediate flange 30. As shown in FIGS. 3A–3C, intermediate flange 30 includes a plurality of first bolt apertures 44, and preferably four first bolt apertures 44 located at intervals around the circumference of intermediate flange 30.

Intermediate flange 30 is also removably attached to axial pump 60. Intermediate flange 30 may be removably attached to pump 60 by any reversible attaching means known to one of skill in the art including, but not limited to bolts, a C-clamp and the like. It is preferred that pump 60 includes a plurality of pump bolt apertures 64 each complementary to an intermediate flange first bolt aperture 44. In the preferred pump system 10, bolt 90 is passed upwardly through pump bolt aperture 64, through first bolt aperture 44 and into a complementary threaded aperture 21 in motor 20 (not shown). As the plurality of bolts 90 are tightened, intermediate flange 30 is compressed between motor 20 and axial pump 60. Alternatively, a first attaching means can be used to unite motor 20 and intermediate flange 30 while a separate second attaching means can be used to unite intermediate flange 30 with axial pump 60. The first and second attaching means may be an attaching device known in the art for reversibly uniting two objects such as bolts, clamps, threaded connectors and the like. What is important is that intermediate flange 30 is reversibly secured between motor 20 and pump 60.

As is shown in FIG. 2, an axial thrust bearing 42 is located in the first recess 34 of intermediate flange 30. Axial thrust bearing 42 abuts first cicumferential face 37 and first cylindrical wall 38 and should fit snugly into first recess 34 so that the rotating portion of axial thrust bearing 42 rotates while the fixed portion does not. Axial thrust bearing 42 is cylindrical in shape and includes an aperture through which drive shaft sleeve 46 fits. Drive shaft sleeve 46 includes a shoulder 47 that abuts axial thrust bearing 42 and that prevents drive shaft sleeve 46 from passing entirely through the axial thrust bearing aperture. When associated with associated pump system 10 of this invention, axial thrust bearing 42 provides for the efficient axial transfer of rotational power from motor 20 to pump 60 while absorbing non axial stresses caused by the rotation of wobble disc assembly 62.

Drive shaft sleeve 46 may be associated with axial thrust bearing 42 in any manner known in the art that will allow drive shaft sleeve 46 to rotate in unison with motor drive shaft 24 and with axial thrust bearing 42. For example, drive shaft sleeve 46 may be press fit into the axial thrust bearing aperture, or it may be mechanically attached to axial thrust bearing 42.

Similarly, drive shaft 24 may be associated with drive shaft sleeve 46 by any method known in the art that allows drive shaft 24 to rotate freely in conjunction with axial thrust bearing 42. For example, drive shaft 24 may be press fit into drive shaft sleeve 46, it may be adhesively associated with drive shaft sleeve 46, or it may be mechanically associated with drive shaft sleeve 46. It is preferred that drive shaft sleeve 46 is mechanically associated with drive shaft 24 using one or more set screws 28 passing perpendicularly through drive shaft sleeve 46 and into drive shaft 24.

Intermediate flange 30 may include an optional first "O"-ring 48 that fits into a first "O"-ring recess 49 surrounding intermediate flange aperture 32.

One or more vibration dampeners 50 may be associated with intermediate flange 30 and with horizontal platform 80. Vibration dampeners 50 dampen any noise and vibration caused by motor 20 thereby stabilizing and protecting pump 60 and other pump system parts from mechanical fatigue. It is preferred that pump system 10 of this invention include at least three vibration dampeners 50 spaced at 120° intervals around the circumference of intermediate flange 30.

In order to accomodate the preferred vibration dampeners, intermediate flange 30 includes a plurality of second bolt apertures 52. Each vibration dampener 50 includes a first threaded end 53 and a second threaded end 54 divided by a dampening block 55. Dampening block 55 may be manufactured from rubber, any synthetic rubber or rubber-like material, or out of any material known to one of skill in the art to be useful for vibration dampening. Each vibration dampener 50 is associated with pump system 10 directing first threaded end 53 of vibration dampener 50 through a second bolt aperture 52 and thereafter threading first threaded end 53 into a complementary threaded aperture in motor 20. Next, second threaded end 54 is directed through a hole 82 in horizontal platform 80 and thereafter the vibration dampener 50 is secured to horizontal platform 80 with a complementary nut 84.

Intermediate flange 30 may include an opening 56. Opening 56 allows air to enter and exit from the space created when intermediate flange 30 is attached to motor 20 thereby helping to cool motor 20 and intermediate flange 30. Opening 56 also provides an egress point for oil or gasoline that may seep from motor 20.

A second "O"-ring 57 is preferably located at the point where intermediate flange 30 and pump 60 are united. Second "O"-ring 57 creates a seal that prevents the ingress and egress of materials to and from oil filled pump chamber 68 when intermediate flange 30 is compressively associated with pump 60.

Pump system 10 of this invention includes an axial drive pump 60. Any type of axial driven pump 60 may be used with this invention. It is preferred, however, that pump system 10 includes an axial drive piston pump.

Figure 4:
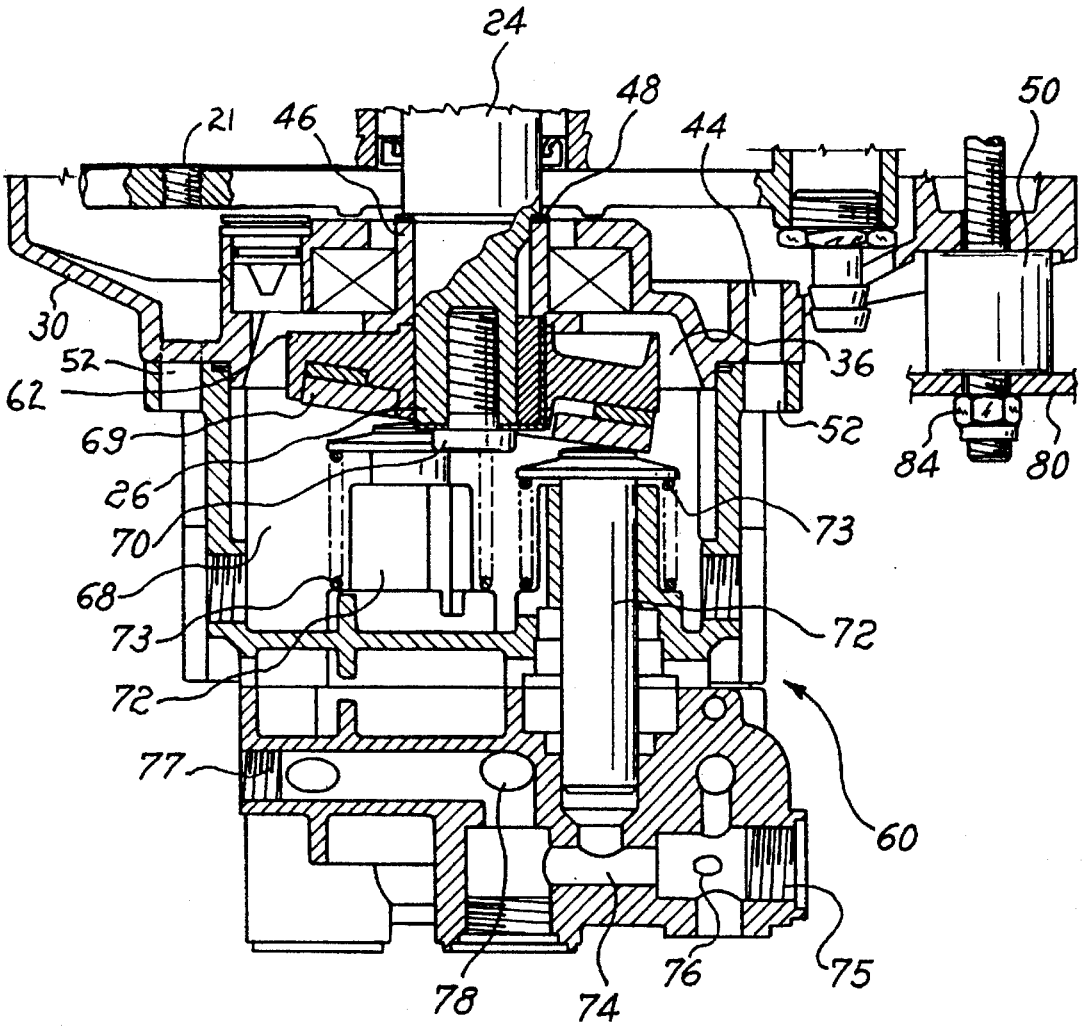
FIG. 4 is a side cutaway view of a type of axial drive piston pump that is useful in association with the vertically oriented high pressure water pump system of this invention.

FIG. 4 is a front cutaway view showing various elements of a preferred axial drive piston pump 60 useful in the pump system of the invention. While an understanding of the precise operation of the preferred axial drive piston pump 60 is not necessary to allow one of skill in the art to practice this invention, an explanation of the operation of the preferred axial drive piston pump 60 is included for a complete understanding of the vertically oriented high pressure water pump system 10 of this invention.

Axial drive piston pump 60 is contained within pump housing 66 and includes an oil filled pump chamber 68 containing three piston 72. Pump 60 includes a wobble disc assembly 62 that further includes an eccentric plate 69 attached to end 26 of drive shaft 24. Wobble disc assembly 62 may be attached to end 26 of drive shaft 24 by any means known in the art. A preferred attaching method is a screw 70 that passes partially through wobble disc assembly 62 and into a threaded aperture at end 26 of drive shaft 24.

Wobble disc assembly 62 fits into second recess 36 of intermediate flange 30. Unlike axial thrust bearing 42, however, wobble disc assembly 62 does not touch intermediate flange 30 but, instead, freely rotates within second recess 36.

Wobble disc 62 actuates pump 60 via the rotation of drive shaft 24. Rotations of drive shaft 24 causes wobble disc assembly 62 to rotate around a fixed axis. Eccentric plate 69 continuously contacts a plurality of pistons 72 associated with pump 60 and rotation of wobble disc assembly 62 also rotates eccentric plate 69. As its name implies, eccentric plate 69 rotates in a non-planar, eccentric manner with respect to pistons 72 thereby causing each of the plurality of pistons 72 to go through a full range of vertical motion for each rotation of eccentric plate 69.

As eccentric plate 69 rotates, it moves piston 72 away from motor 20 and towards pump 60 thereby causing water to flow through outlet check valve 78 and through outlet port 77. Upon further rotation, eccentric plate 69 begins to move towards motor 20 and away from piston 72 causing spring 73 to urge piston 72 away from water flow chamber 74 and towards eccentric plate 69 thereby drawing water into inlet port 75 and through inlet check valve 76. Upon further rotation, eccentric plate 69 once again urges piston 72 towards water flow chamber 74 causing the water pressure in the chamber to increase and water once again flows through check valve 78 and outlet port 77. The preferred pump 60 axial drive piston includes three pistons which operate in unison but out of phase to produce a constant high pressure stream of water.

Figure 5:
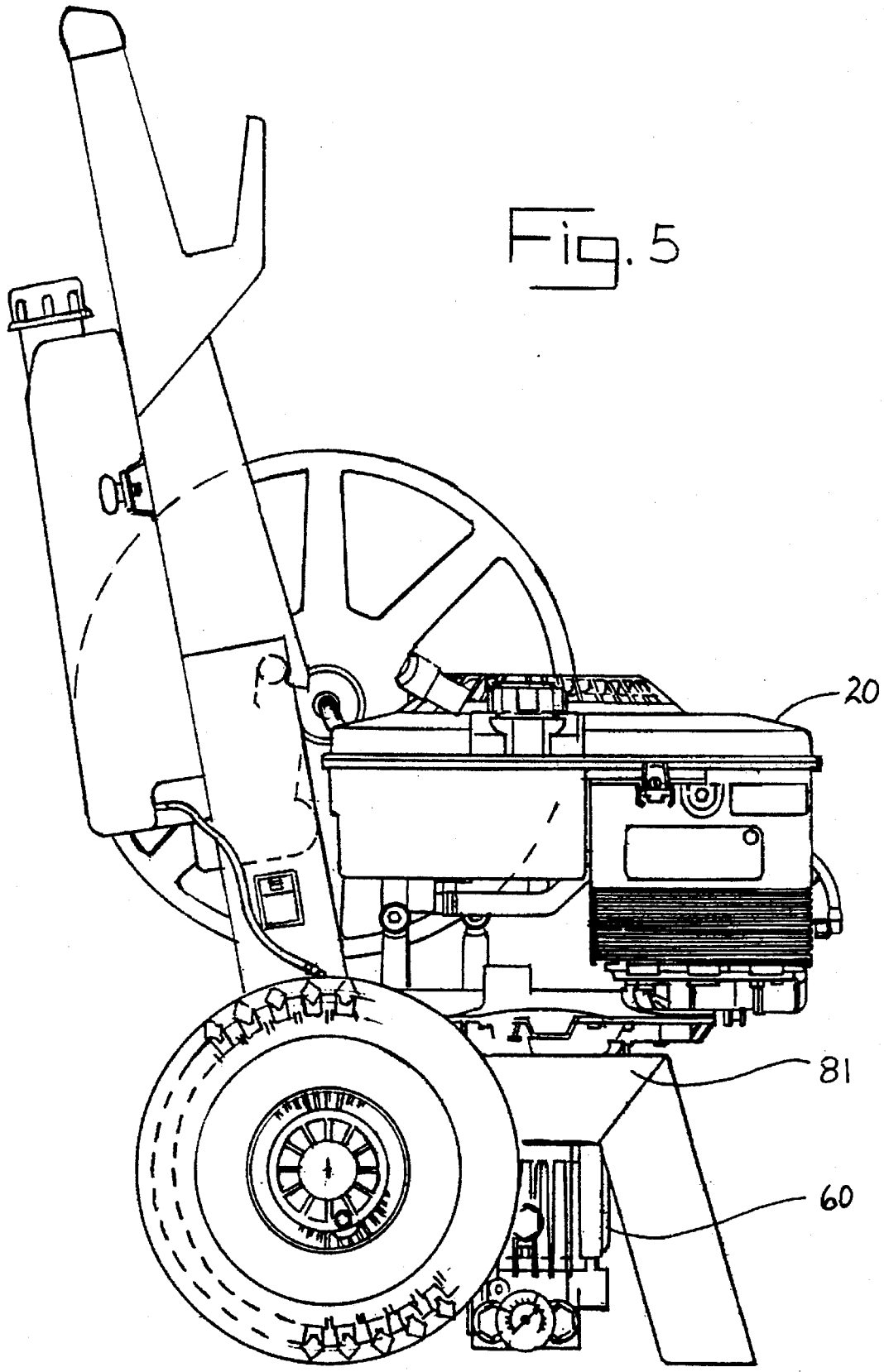
FIG. 5 is a side view of and vertically oriented high pressure water pump associated with a wheeled horizontal platform.

Horizontal platform 80 may be any type of platform capable of supporting the vertically oriented high pressure water pump system 10 of this invention. Horizontal platform 80 may be a fixed platform such as a bench or a table or it can be a wheeled horizontal platform 81, as shown in FIG. 5.

The description above has been offered for illustrative purposes only, and it is not intended to limit the scope of the invention of this application which is defined in the following claims.

What I claim is:

1. A vertically oriented high pressure water pump system comprising:

an internal combustion engine including an motor housing, a downwardly oriented vertical drive shaft having an end, and a plurality of motor bolt apertures;

an intermediate flange having an aperture, a first recess, a second recess, and a plurality of first bolt apertures;

an axial thrust bearing located in the first recess of the intermediate flange;

a drive shaft sleeve located in the intermediate flange aperture and attached to the drive shaft and at least partially surrounded by the axial thrust bearing such that rotation of the drive shaft causes the thrust bearing and the drive shaft sleeve to rotate in unison;

an axial drive piston pump including a plurality of pump bolt apertures, each pump bolt aperture complementary to a first bolt aperture and complementary to a motor bolt aperture;

a bolt associated with each first bolt aperture, pump bolt aperture; and motor bolt aperture for compressively securing the intermediate flange between the motor and the axial drive piston pump; and a wobble disc assembly attached to the end of the drive shaft and located in the second recess of the intermediate flange and attached to the end of the drive shaft.

2. The vertically oriented high pressure water pump system of claim 1, wherein a horizontal platform supports the pump system.

3. The vertically oriented high pressure water pump system of claim 2, wherein the pump system is united with the horizontal platform by a plurality of vibration dampeners.

4. The vertically oriented high pressure water pump system of claim 3, wherein the vibration dampeners are spaced at 120° intervals around the circumference of the horizontal platform.

5. The vertically oriented high pressure water pump system of claim 4, wherein the horizontal platform is a wheeled vertical platform.

6. A vertically oriented high pressure water pump system comprising:

an internal combustion engine including an motor housing, a downwardly oriented vertical drive shaft having an end, and a plurality of motor bolt apertures;

an intermediate flange having an aperture, a first recess, a second recess, a plurality of first bolt apertures and a plurality of second bolt apertures spaced at intervals around the circumference of the intermediate flange;

an axial thrust bearing fixedly located in the first recess of the intermediate flange;

a drive shaft sleeve attached to the drive shaft and at least partially surrounded by the axial thrust bearing such that rotation of the drive shaft causes the thrust bearing and the drive shaft sleeve to rotate in unison;

an axial drive piston pump including a plurality of pump bolt apertures, each pump bolt aperture being complementary to a first bolt aperture and to a motor bolt aperture;

a bolt associated with each first bolt aperture, pump bolt aperture; and motor bolt aperture for compressively securing the intermediate flange between the motor and the axial drive piston pump;

a wobble disc assembly located in the second recess of the intermediate flange and attached to the drive shaft end for driving the axial drive piston pump; and a wheeled horizontal platform and a plurality of vibration dampeners each having a first threaded end associated with the wheeled horizontal platform and a second threaded end associated with a first bolt aperture, the vibration dampeners securing the high pressure water pump assembly to the wheeled horizontal platform.

7. The vertically oriented high pressure water pump of claim 6, wherein the horizontal platform is a wheeled vertical platform.

8. The vertically oriented high pressure water pump system of claim 7 wherein each vibration dampener is associated with a first bolt aperture located at intervals around the circumference of the intermediate flange and connect the high pressure pump system to the horizontal platform.

* * * * *

UNITED STATES PATENT AND TRADEMARK OFFICE

CERTIFICATE OF CORRECTION

PATENT NO. : 5,653,584

DATED : August 5, 1997

INVENTOR(S) : Roberto Mazzucato, et. al.

It is certified that error appears in the above-identified patent and that said Letters Patent is hereby corrected as shown below:

Title page, item [30] Foreign Application Priority Data should read--
July 13, 1995 [IT] Italy.....MI95 A 001498--

Signed and Sealed this

Twenty-sixth Day of December, 2000

*Attest:*

Q. TODD DICKINSON

*Attesting Officer*

*Director of Patents and Trademarks*